US007883229B2

(12) United States Patent
Choi

(10) Patent No.: US 7,883,229 B2
(45) Date of Patent: Feb. 8, 2011

(54) APPARATUS AND METHOD FOR CONTROLLING LAMP OF REFRIGERATOR

(75) Inventor: Woong Chul Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1005 days.

(21) Appl. No.: 11/318,614

(22) Filed: Dec. 28, 2005

(65) Prior Publication Data

US 2006/0137378 A1 Jun. 29, 2006

(30) Foreign Application Priority Data

Dec. 28, 2004 (KR) ..... 10-2004-0113574

(51) Int. Cl.
*F25D 27/00* (2006.01)
*F25D 23/00* (2006.01)

(52) U.S. Cl. ..... 362/94; 62/264

(58) Field of Classification Search ..... 62/156, 62/157, 264, 265; 315/219, 219.312, 312; 362/94

See application file for complete search history.

(56) References Cited

U.S. PATENT DOCUMENTS

| | | | | |
|---|---|---|---|---|
| 5,228,300 | A * | 7/1993 | Shim | 62/80 |
| 5,548,969 | A * | 8/1996 | Lee | 62/228.4 |
| 5,768,898 | A * | 6/1998 | Seok et al. | 62/132 |
| 2003/0056526 | A1 * | 3/2003 | Holmes et al. | 62/156 |

FOREIGN PATENT DOCUMENTS

| | | | |
|---|---|---|---|
| KR | 2000-0042122 | * | 7/2000 |
| KR | 2003-0064554 | * | 8/2003 |

* cited by examiner

*Primary Examiner*—Frantz F Jules
*Assistant Examiner*—Emmanuel Duke
(74) *Attorney, Agent, or Firm*—Ked & Associates LLP

(57) ABSTRACT

A refrigerator includes the ability to determine the amount of time that a light within the refrigerator remains on. If the on time exceeds a predetermined time period, the light is turned off. If the door of the refrigerator is repeatedly opened and closed, the total accumulated on time is monitored, and the light will be turned off when the total on time exceeds the predetermined time period. If the light remains off for more than a cooling off period, the accumulated on time timer is reset, and the light can again be turned on.

16 Claims, 4 Drawing Sheets

APPARATUS AND METHOD FOR CONTROLLING LAMP OF REFRIGERATOR

BACKGROUND OF THE INVENTION

1. Field of Invention

The present invention relates to an apparatus and method for controlling a lamp in a refrigerator, and more particularly, to an apparatus and method for controlling a lamp in a refrigerator, wherein a time period when the refrigerator lamp is turned on is added up while the lamp is repeatedly turned on and off, and the lamp is temporarily turned off when the added time period reaches a predetermined time period, so that the lamp can be prevented from being overheated and parts positioned adjacent thereto from being thus deformed due to heat generated from the lamp.

2. Description of the Prior Art

In general, a refrigerator is provided with a refrigerating chamber and a freezing chamber corresponding to an internal space in a refrigerator cabinet. A machine room with a certain space is provided at a rear side of the refrigerator cabinet and mounted with cooling devices for maintaining the refrigerating/freezing chambers at a low temperature state.

The cooling devices are composed of a compressor for compressing a refrigerant transferred through a refrigerant pipe at high temperature and high pressure, a condenser for cooling down the refrigerant compressed by the compressor to low temperature and high pressure, and an expansion valve for converting the cooled refrigerant into a low pressure state, so that the low pressure refrigerant can absorb heat and evaporate through the expansion valve to maintain the interior of the refrigerator at a low temperature state.

The refrigerator is provided with a lamp, which is a lighting device in the refrigerator, for illuminating the interior of the refrigerating and freezing chambers. The lamp is configured in such a manner that it is turned on and off when a refrigerator door is closed and opened, respectively.

FIG. 1 is a flowchart illustrating a method for controlling a lamp in a refrigerator according to a prior art.

According to the method for controlling the refrigerator lamp according to the prior art, the lamp in the refrigerator is turned on when the refrigerator door is opened (S1, S2). Then, while the lamp is kept at its ON state, the lamp is turned off after a predetermined time period has passed (S3, S4).

That is, the method for controlling the refrigerator lamp according to the prior art is configured in such a manner that the lamp is turned off to reduce the deformation of injection molded parts in the refrigerator due to heat generated from the lamp for a long time, if a state where the lamp is turned on is maintained over a predetermined time period.

However, the related art control method has a limitation in preventing heat from residing near the lamp, which is caused by the repetitive turning on and off of the lamp due to the frequent opening and closing of the refrigerator door.

In particular, in a case where a high power lamp is installed in the refrigerator to allow the interior of the refrigerator to be brighter, heat quantity generated in and near the lamp is increased as the number of times the lamp is turned on and off is increased. Thus, this increase in heat quantity leads to the deformation of the injection molded parts positioned adjacent to the lamp, and consequently, to the occurrence of fire.

SUMMARY OF THE INVENTION

Accordingly, the present invention is conceived to solve the aforementioned problem in the prior art. An object of the present invention is to provide an apparatus and method for controlling a lamp in a refrigerator wherein a time period when the refrigerator lamp is turned on is added up (accumulatively calculated) during the repeated turning on and off operation of the lamp and the lamp is temporarily turned off when the added time period reaches a predetermined time period, so that heat generated in and near the lamp can be cooled down.

According to an aspect of the present invention for achieving the object, there is provided a method for controlling a lamp in a refrigerator in which the refrigerator lamp has been turned on or off at least once. The method of the present invention comprises the steps of accumulatively calculating a time period when the lamp is turned on during opening/closing of a refrigerator door, and controlling turning off the lamp if the accumulative time period when the lamp is turned on exceeds a predetermined time period value.

According to another aspect of the present invention, there is provided a method for controlling a lamp in a refrigerator in which the refrigerator lamp has been turned on or off at least once. The method of the present invention comprises the steps of (a) calculating a time interval from a point of time when an refrigerator door is closed and the lamp is thus turned off to a point of time when the door is opened again, (b) determining whether the calculated time interval exceeds a predetermined time interval value, and (c) controlling temporarily turning off the lamp when it is determined in step (b) that the calculated time interval does not exceed the predetermined time interval value and simultaneously an accumulative sum of the time period when the lamp has been turned on exceeds a predetermined accumulative sum value.

According to a further aspect of the present invention, there is provided an apparatus for controlling a lamp in a refrigerator, comprising a door sensing unit for detecting whether the door is opened or closed, and a lamp control unit for turning on or off the refrigerator lamp in response to a sensing signal transferred from the door sensing unit and controlling turning on or off the lamp based on a time interval calculated from a point of time when the door is closed and the lamp is thus turned off to a point of time when the door is opened again.

BRIEF DESCRIPTION OF THE DRAWINGS

The above and other objectives, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of the present invention will be described in detail with reference to the accompanying drawings.

Herein, a "lamp" means a general lamp including an incandescent lamp, a halogen lamp or another kind of lamp. Further, the present invention is not limited to the size, shape, kind and the like of lamp. In addition, a term "refrigerator"

used herein is used to include a variety of storage devices capable of storing certain articles at a cold/hot state in addition to a general refrigerator which will be explained later with reference to FIG. 2.

Figure 1:
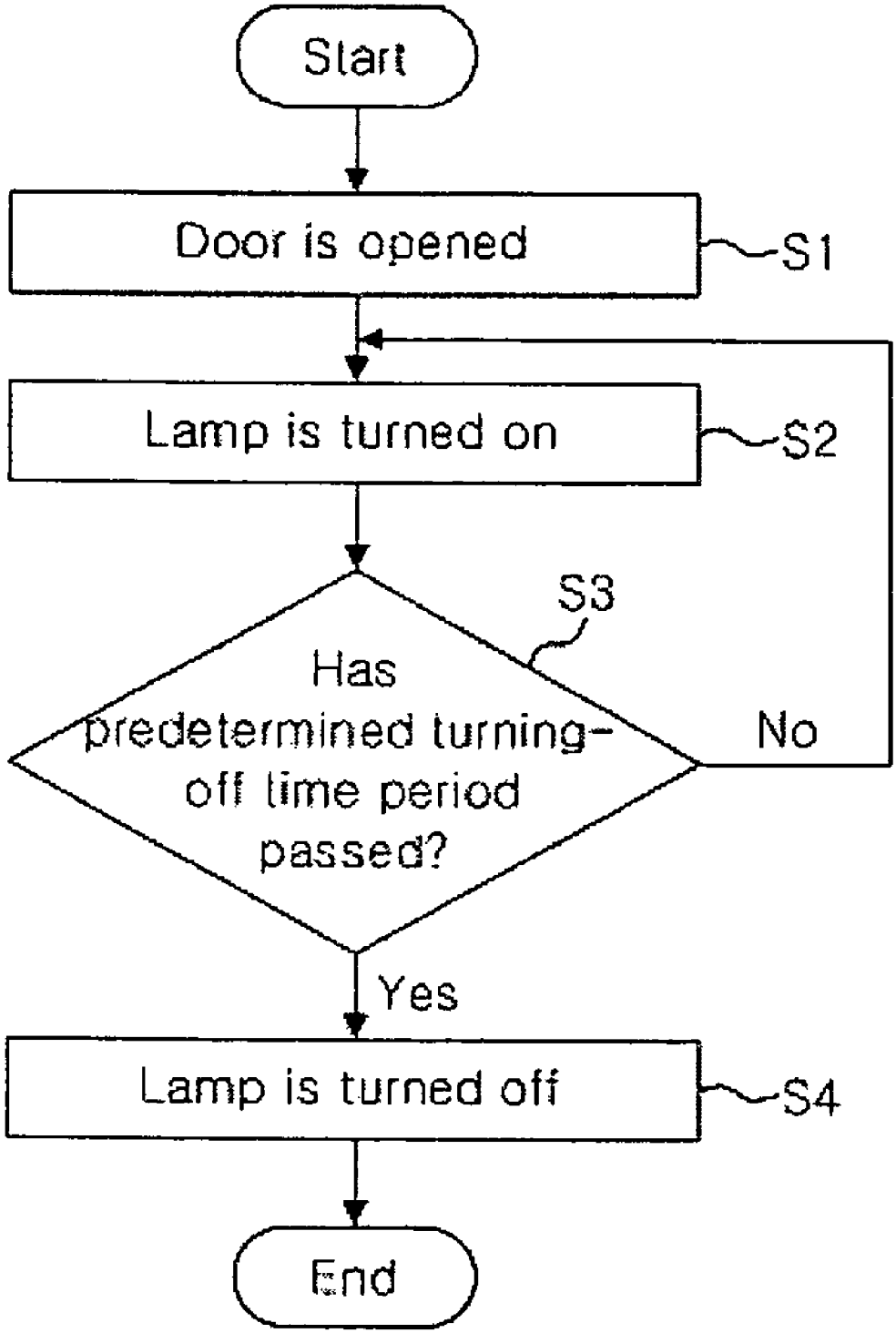
FIG. 1 is a flowchart illustrating a method for controlling a lamp in a refrigerator according to a prior art.
Figure 2:
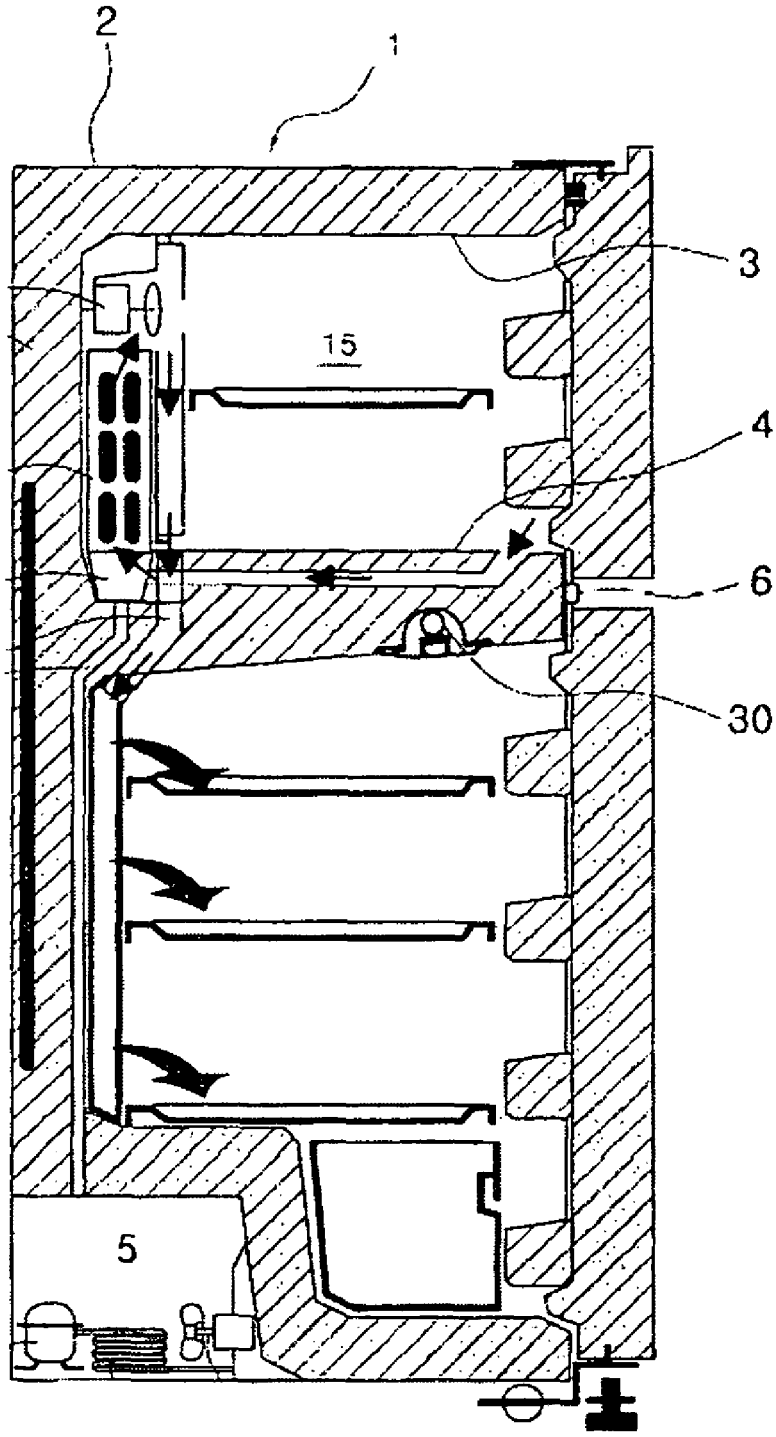
FIG. 2 is a sectional view showing the configuration of a refrigerator according to a preferred embodiment of the present invention.

FIG. 2 is a sectional view illustrating the configuration of a refrigerator according to the preferred embodiment of the present invention.

The refrigerator 1 of this embodiment is configured in such a manner that an inner case 3 defining an inner storage space of the refrigerator 1 is fixed to an inner surface of an outer case 2 defining an external appearance of the refrigerator.

Further, foam liquid is filled between the outer case 2 and the inner case 3 and is formed into an insulation layer after the filled foam liquid has been solidified.

A barrier 4 for dividing the storage space into refrigerating and freezing chambers positioned in a vertical direction is formed inside the inner case 3. In addition, refrigerating and freezing chamber doors for opening and closing the refrigerating and freezing chambers are hinged to one side of the refrigerator 1.

A blowing fan for supplying refrigerant heat exchanged in an evaporator to the refrigerating or freezing chamber is installed at a rear side of the refrigerator 1. Under the blowing fan is provided a defrost water gutter for collecting defrost water produced in the process of defrosting the evaporator and then transferring the collected defrost water to a drain pipe.

Further, a machine room 5 is installed at a lower rear portion of the refrigerator 1. A compressor for compressing refrigerant evaporated in the evaporator, a condenser for condensing the compressed refrigerant, and a fan for cooling the compressor and condenser are installed in the machine room 5.

A cold air duct through which cold air flows in the refrigerating chamber and a return duct through which the cold air circulated in the freezing chamber flows in the evaporator are formed within the interior of the barrier 4. Each of the refrigerating and freezing chambers is mounted with a temperature sensor for measuring the temperature in the chamber and a temperature control knob for adjusting the temperature in the chamber.

In the meantime, a door switch 6 is provided at a certain position on a front surface of the barrier 4. The door switch is electrically switched on and off when the refrigerator door is opened and closed, respectively. A lamp 30 provided at a certain position on a bottom surface of the barrier 4 is turned on or off in response to the on/off operation of the door switch 6.

Figure 3:
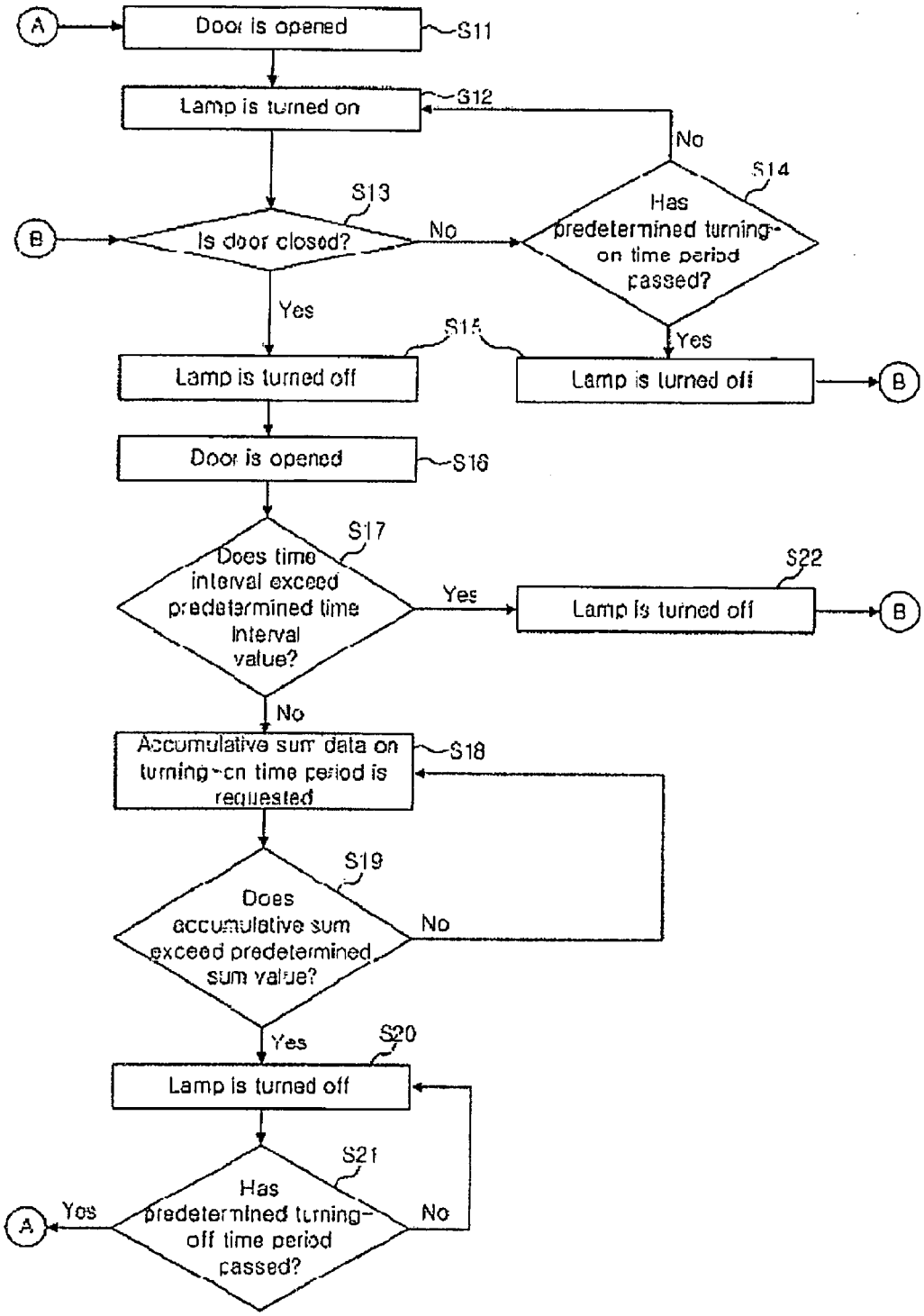
FIG. 3 is a flowchart illustrating a method for controlling a lamp in a refrigerator according to the present invention.

FIG. 3 is a flowchart illustrating a method for controlling a lamp in a refrigerator according to the present invention.

First, if the refrigerator door is opened (S11), the door switch is electrically switched on and then the refrigerator lamp is turned on (S12). Here, it is assumed that before the door is opened (S11), the lamp has been sufficiently maintained at a state where it is turned off and a timer for counting up a time period when the lamp is turned on also has been initialized as zero (0).

If the lamp is turned on, the turning-on time period is counted up using the timer. It is determined whether the counted turning-on time period exceeds a predetermined turning-on time period value (S14). At this time, it is also determined whether the door is closed (S13). If the door is closed or the counted turning-on time period exceeds the predetermined turning-on time period value, the lamp is turned off. On the other hand, if neither the door is closed nor the counted turning-on time period exceeds the predetermined turning-on time period value, the lamp is kept turned on.

Meanwhile, if the door is closed, the lamp is also turned off. Then, if the door is opened again, the door switch detects the opening of the door to calculate a time period from a point of time when the lamp has been turned off to a point of time w hen the door switch detects that the door is again opened, i.e. a time interval between the two points of time, using the timer (S15 and S16).

Next, it is determined whether the calculated time interval exceeds a predetermined time interval value (S17). If the calculated time interval exceeds the predetermined time interval value, the lamp is turned on (S22). On the other hand, if the time interval is within the predetermined time interval value, data on an accumulative sum of the time period while the lamp has been previously turned on are requested (S18). Here, the accumulative sum has been obtained by accumulatively calculating the time period when the lamp is turned on, which is counted up by the timer after the lamp and adjacent parts have been sufficiently cooled and then the timer has been initialized. This process of calculating the accumulative sum is continuously performed while the lamp is repeatedly turned on and off after the timer has been initialized.

Next, it is determined whether the aforementioned accumulative sum of the time period when the lamp has been turned on exceeds a predetermined sum value (S19). Then, if the accumulative sum does not exceed the predetermined sum value, the lamp remains turned on. If the accumulative sum exceeds the predetermined sum value, the lamp is turned off for a certain time period (S19, S20).

At this time, the time period when the lamp is turned off during the step S20 is determined based on data on a predetermined turning-off time period value (S21). If the time period when the lamp has been turned off exceeds the predetermined turning-off time period value, the timer is again initialized and the aforementioned process of turning on or off the lamp due to the opening/closing of the door will be repeatedly controlled.

Figure 4:
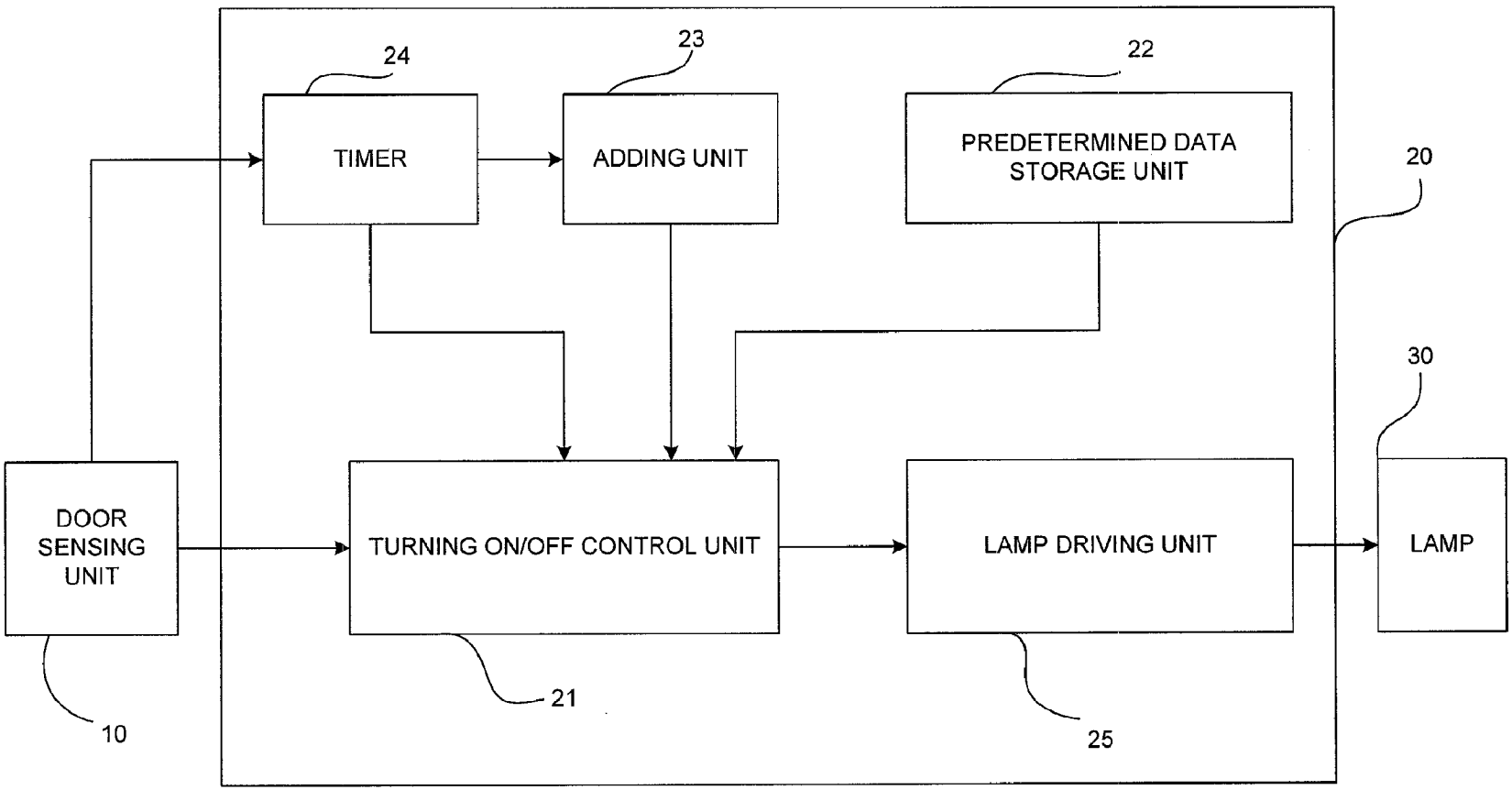
FIG. 4 is a block diagram illustrating the configuration of an apparatus for controlling a lamp in a refrigerator according to the embodiment of the present invention.

Hereinafter, the configuration of an apparatus for performing the aforementioned control of the refrigerator lamp will be described. FIG. 4 is a block diagram illustrating the configuration of the apparatus for controlling the refrigerator lamp according to the embodiment of the present invention.

The apparatus for controlling the refrigerator lamp of the present invention comprises a door sensing unit 10 for sensing the opening/closing of the refrigerator door, and a lamp control unit 20 for turning on or off the lamp 30 in response to sensing signals transferred from the door sensing unit 10 and turning off the lamp 30 based on the time interval calculated from the point of time when the lamp 30 has been turned off to the point of time when the door has been again opened in a case where the door is opened again.

The door sensing unit 10 is to detect the opening/closing of the door of the refrigerator 1 and turn on or off the lamp 30 in response to the detected result. Herein, the door sensing unit 10 includes the door switch 6 which is only one example, but the present invention is not limited thereto.

In the meantime, the lamp control unit 20 includes an adding unit 23 for accumulatively calculating (i.e., adding) the time period when the lamp 30 is turned on, and a turning on/off control unit 21 for determining whether the time period (i.e., added sum) added by the adding unit 23 exceeds the predetermined sum value and then turning off the lamp 30 for a predetermined time period if the added time period exceeds the predetermined sum value.

Further, the lamp control unit 20 includes a lamp driving unit 25 for supplying or cutting off operating electric power to the lamp 30 in response to control signals from the turning on/off control unit 21. The lamp control unit 20 may further include a data storage unit 22 for storing the predetermined time interval value, turning-off time period, turning-on time period and added sum value data as comparison data for use in controlling the operation of the lamp 30.

At this time, the predetermined time interval value, turning-off time period value, turning-on time period value and accumulative sum value data stored in the data storage unit 22 may be changed by a manufacturer. In some cases, the above data may be separately set by a user of the refrigerator 1.

The turning on/off control unit 21 generates control signals for turning on or off the lamp 30 and transfers the generated control signals to the lamp driving unit 25. Further, the turning on/off control unit 21 generates control signals for controlling the time period calculation operation of the timer 24 and transfers the generated control signals to the timer 24.

That is, the turning on/off control unit 21 generates the signals for either turning on the lamp 30 when the door switch 6 is switched on due to the opening of the door or turning off the lamp 30 when the predetermined turning-off time period has passed or the switch 6 is switched off due to the closing of the door, and transfers the generated signals to the lamp driving unit 25.

Further, the turning on/off control unit 21 determines whether the time interval from the point of time when the lamp is turned off to the point of time when the detected signals are transferred is within the predetermined time interval value: If the time interval is within the predetermined time interval value, a request signal for the time period when the lamp is turned on is generated. When it is determined that the added sum calculated from the adding unit 23 is compared with and then exceeds the predetermined sum value stored in the data storage unit 22, the control signals are generated to turn off the lamp 30 and then transferred to the lamp driving unit 25.

An apparatus and method for controlling a lamp in a refrigerator according to the present invention is configured in such a manner that a time period when the lamp is turned on is added and the lamp is temporarily turned off when the added time period exceeds a predetermined time period. Therefore, a time for cooling heat generated near the lamp is secured such that the deformation of injection molded parts near the lamp and the fire hazard due to the heat from the lamp can be prevented. Accordingly, there is an advantage in that the safety of the user can be greatly improved.

Furthermore, it is possible to at least partially prevent the lamp from being repeatedly turned on or off due to frequent opening/closing of the refrigerator door. Therefore, there is another advantage in that unnecessary consumption of electric power can be reduced.

Although the apparatus and method for controlling a lamp in a refrigerator according to an embodiment of the present invention has been explained herein with reference to the illustrated drawings, the present invention is not limited thereto. The technical spirit of the present invention in which a time period when the lamp is turned on is accumulatively calculated and the lamp is temporarily turned off when the calculated time period exceeds a predetermined time period such that heat generated near the lamp can be cooled or dissipated can be easily implemented by those skilled in the art. Therefore, the scope of the present invention should be construed on the basis of the appended claims.

What is claimed is:

1. A method for controlling an illumination lamp of a refrigerator, comprising:

calculating an accumulative sum of time periods that the lamp is turned on as a door of the refrigerator is repeatedly opened and closed and after said calculating:

detecting closing of the door by a detector;

turning off the lamp in response to detection of the door closing;

detecting opening of the door after detection of the door closing;

calculating a time interval from a time that at least one of the door was detected to be closed or the lamp is turned off to a time that the door was detected to be opened;

keeping the lamp off after the door was detected to be opened if the time interval does not exceed a predetermined time interval and the accumulative sum exceeds a predetermined accumulative sum; and turning the lamp on after the door was detected to be opened if the time interval exceeds the predetermined time interval or the accumulative sum does not exceed the predetermined accumulative sum.

2. The method of claim 1, further comprising:

resetting the accumulative sum to zero if the calculated time interval exceeds the predetermined time interval.

3. The method of claim 2, further comprising turning the lamp on if the time interval does not exceed the predetermined time interval and the accumulative sum also does not exceed a predetermined accumulative sum.

4. The method of claim 3, further comprising:

after the lamp is turned on, turning the lamp off while the door is opened if the time period that the lamp is on exceeds the predetermined accumulative sum.

5. The method of claim 3, further comprising:

after said keeping, turning the lamp on if the lamp remains off for more than the predetermined time interval;

resetting the accumulative sum to zero, and calculating the accumulative sum based on subsequent repeated opening and closing of the door.

6. The method of claim 1, further comprising turning the lamp on if the time interval does not exceed the predetermined time interval and the accumulative sum also does not exceed a predetermined accumulative sum.

7. The method of claim 1, further comprising:

after said keeping, turning the lamp on if the lamp remains off for more than the predetermined time interval;

resetting the accumulative sum to zero, and calculating the accumulative sum based on subsequent repeated opening and closing of the door.

8. An apparatus for controlling an illumination lamp of a refrigerator, comprising a detector; and one or more controllers to:

calculate an accumulative sum of time periods that the lamp is turned on as a door of the refrigerator is repeatedly opened and closed, and after the accumulative sum is calculated:

turn off the lamp in response to detection of the door closing by the detector; and after the door is detected to be opened by the detector, calculate a time interval from a time that at least one of the door was detected to be closed by the detector or the lamp was turned off to a time that the door was detected to be opened;

keep the lamp off after the door was detected to be opened if the time interval does not exceed a predetermined time interval and the accumulative sum exceeds a predetermined accumulative sum; and turn the lamp on after the door was detected to be opened if the time interval exceeds the predetermined time interval or the accumulative sum does not exceed the predetermined accumulative sum.

9. The apparatus of claim 8, wherein the one or more controllers reset the accumulative sum to zero if the calculated time interval exceeds the predetermined time interval.

10. The apparatus of claim 9, wherein the one or more controllers turn the lamp on after the door is detected to be opened if the time interval does not exceed the predetermined time interval and the accumulative sum also does not exceed a predetermined accumulative sum.

11. An apparatus for controlling an illumination lamp of a refrigerator, comprising:

a door sensor that determines when a door of the refrigerator is opened and closed; and a controller that controls an illumination lamp, wherein the controller:

calculates an accumulative sum of time periods that the lamp is turned on as the door of the refrigerator is repeatedly opened and closed, calculates a time interval from a time that at least one of the door is closed or the lamp is turned off to a next time that the door is opened, keeps the lamp off after the door is opened if the time interval does not exceed a predetermined time interval and the accumulative sum exceeds a predetermined accumulative sum, and turn the lamp on after the door is opened if the time interval exceeds the predetermined time interval or the accumulative sum does not exceed the predetermined accumulative sum.

12. The apparatus of claim 11, wherein the controller turns the lamp on after the door is opened and resets the accumulative sum to zero if the calculated time interval exceeds the predetermined time interval.

13. The apparatus of claim 12, wherein the controller turns the lamp on if the time interval does not exceed the predetermined time interval and the accumulative sum also does not exceed a predetermined accumulative sum.

14. The apparatus of claim 11, wherein the controller turns the lamp off after the lamp is turned on and the door is opened when the accumulative sum exceeds the predetermined accumulative sum.

15. The apparatus of claim 11, wherein after the lamp is turned on the controller:

turns the lamp off while the door is opened when the accumulative sum exceeds the predetermined accumulative sum, resets the accumulative sum to zero, and keeps the lamp turned off for a period of time equal to the predetermined time interval.

16. The apparatus of claim 11, wherein when the lamp has remained off for a period of time equal to the predetermined time interval, the controller resets the accumulative time to zero.

* * * * *